US006788177B1

(12) United States Patent
Weber

(10) Patent No.: US 6,788,177 B1
(45) Date of Patent: Sep. 7, 2004

(54) COMMONIZED ACTUATOR FOR NORMALLY OPEN AND NORMALLY CLOSED MODES

(75) Inventor: Alexis C. Weber, Chihuahua (MX)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/382,152

(22) Filed: Mar. 5, 2003

(51) Int. Cl.[7] ..... H01F 7/18
(52) U.S. Cl. ..... 335/268; 335/251; 335/220
(58) Field of Search ..... 335/220, 229, 335/230, 268, 251; 251/159.1

(56) References Cited

U.S. PATENT DOCUMENTS 3,683,239 A * 8/1972 Sturman ..... 361/194
3,806,850 A * 4/1974 McFarlin ..... 335/203
4,679,017 A * 7/1987 Mishler et al. ..... 335/164
6,486,762 B2 * 11/2002 Kurasawa et al. ..... 335/278
6,578,933 B2 6/2003 Hageman et al.

* cited by examiner

*Primary Examiner*—Lincoln Donovan
*Assistant Examiner*—Bernard Rojas
(74) *Attorney, Agent, or Firm*—Jimmy L. Funke

(57) ABSTRACT

An actuator assembly operates a device in a normally open mode and a normally closed mode. The actuator assembly includes a bobbin around which a coil is wound. The coil receives an electrical current to induce a magnetic field thereabout. A rod extends along the longitudinal axis. The rod is movable along the longitudinal axis in response to the magnetic field. The actuator assembly also includes a plunger extending through a portion of the bobbin. The plunger is movable with respect thereto in response to changes in the magnetic field. The plunger includes a rod receptacle for fixedly securing the rod therein allowing the rod to move with the plunger. The plunger also includes an opposing rod receptacle allowing the rod to be received thereby when the actuator assembly is in the normally closed orientation.

14 Claims, 1 Drawing Sheet

COMMONIZED ACTUATOR FOR NORMALLY OPEN AND NORMALLY CLOSED MODES

BACKGROUND ART

1. Field of the Invention

The invention relates to an electromagnetic actuator. More specifically, the invention relates to an electromagnetic actuator that can be configured in a normally open configuration or a normally closed configuration to push or pull a device.

2. Description of the Related Art

Actuators are used to move devices, or elements thereof, between positions of operation. By way of example, an actuator may move a switch from an open condition to a closed condition. Actuators may also move elements between a plurality of positions. In the case where an actuator operates a valve, a valve may move between open and closed positions. In addition, the actuator may move the valve to a plurality of positions between the open and closed position to regulate a flow of material, i.e., fluid flow, as it passes through the valve by varying the size of the opening created within the valve.

A typical actuator used to automatically move a switch or a valve between conditions is an electromagnetic actuator. While operating under the same principle, an electromagnetic actuator that is designed to be normally open is conceptually different in its layout or design from an electromagnetic actuator that is designed to operate in a normally closed condition. Because the normally open actuator and the normally closed actuator are designed differently, the part designs for each of the actuators varies depending on the type of actuator being used. Because the designs are different, inventory for several parts is required. By increasing the number of parts, costs associated with inventory and assembly for such actuators are increased. In addition, errors in part selection increase as the multiple of part combinations grows due to the increased number of parts based on what condition a particular actuator is to be operating in.

SUMMARY OF THE INVENTION

An actuator assembly operates a device in a normally open mode and a normally closed mode. The actuator assembly includes a frame that extends between a first ridge and a second ridge. A primary plate is adapted to be secured to either the first ridge or the second ridge. The primary plate includes a primary hole. A secondary plate is adapted to be secured to either the first ridge or the second ridge, opposite the end to which the primary plate is secured. The secondary plate includes a secondary hole. A bobbin defining a longitudinal axis extends between the primary and secondary plates. A coil wound around the bobbin receives an electrical current to induce a magnetic field thereabout. A rod extends from within the frame to a device along the longitudinal axis. The rod is movable along the longitudinal axis in response to the magnetic field to open and close the device. The actuator assembly also includes a plunger extending through a portion of the bobbin. The plunger is movable with respect thereto in response to changes in the magnetic field. The plunger includes a rod receptacle for fixedly securing the rod therein allowing the rod to move with the plunger. The plunger is adapted to be oriented in a first orientation allowing the actuator assembly to operate the device in the normally open mode and a second orientation allowing the actuator assembly to operate the device in the normally closed mode.

BRIEF DESCRIPTION OF THE DRAWINGS

Advantages of the invention will be readily appreciated as the same becomes better understood by reference to the following detailed description when considered in connection with the accompanying drawings, wherein.

DETAILED DESCRIPTION OF THE PREFERRED EMBODIMENT

Figure 1:
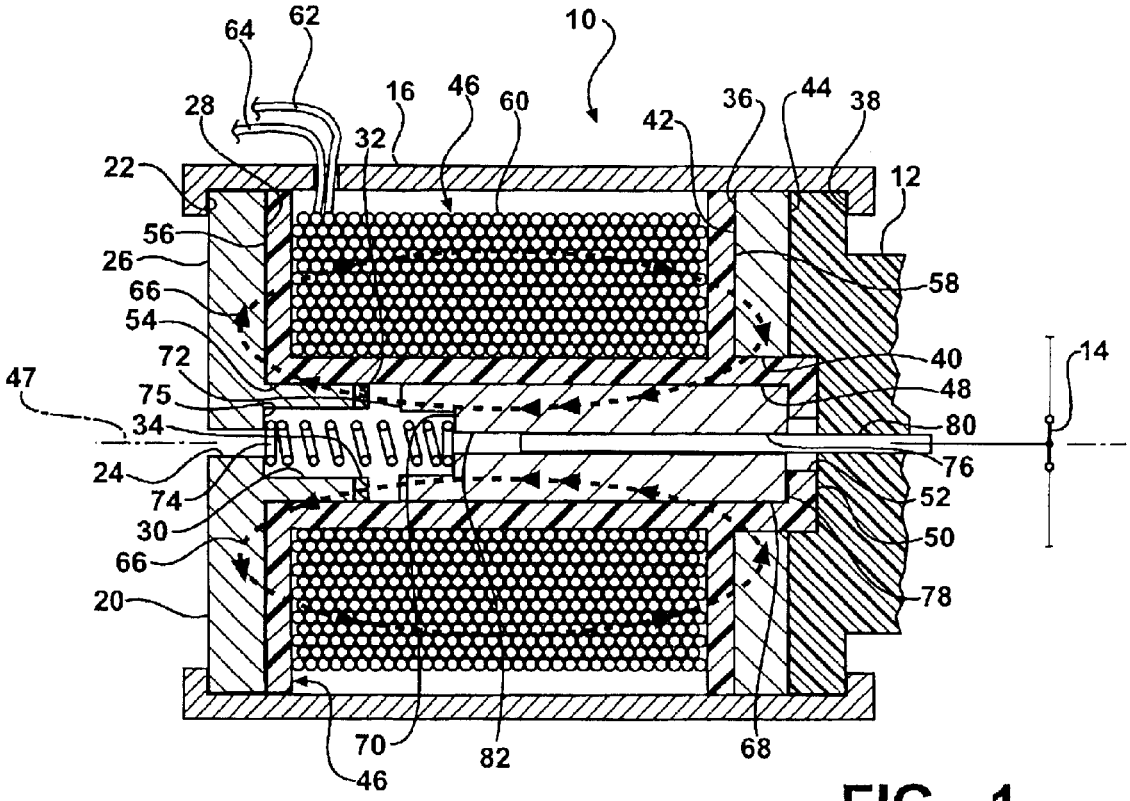
FIG. 1 is a cross-sectional side view of one embodiment of the invention assembled in the normally closed mode.

Referring to FIG. 1, an actuator assembly is generally indicated at 10. The actuator assembly 10 operates a device 12 that includes a switch 14. It should be appreciated by those skilled in the art that the device 12 may be or operate a valve or any other type of device which is to be actuated.

In the orientation of assembly in FIG. 1, the actuator assembly 10 is operating the device in a normally closed mode. More specifically, when the actuator assembly 10 is de-energized, the switch 14 of the device 12 is normally closed. When energized, the actuator assembly 10 moves the switch 14 into an open position. Continuing with the example shown in FIG. 1, upon opening the switch 14, the device 12 is interrupted.

The actuator assembly includes a frame 16. The frame 16 extends around the actuator assembly 10 and acts as a housing for the components thereof. The frame 16 may be a complete enclosure, as shown in FIG. 1, or an open structure allowing components to be accessed at either end as well as having the device 12 be fixedly secured thereto. Except for any mounting brackets that may be incorporated into the design of the frame 16, the frame 16 is preferably symmetric about a longitudinal axis 47.

The actuator assembly 10 includes a primary plate 20. The primary plate 20 extends across one end of the frame 16. The primary plate 20 covers the end of the frame 16 and is held in place by a first ridge, crimp or bent tab 22, which extends inwardly toward the longitudinal axis 47 around the entire periphery of the frame 16. The primary plate 20 includes a primary hole 24 extending therethrough and an outer periphery that is greater than an inner diameter of the first ridge 22. The primary plate 20 has a width that extends between an exterior surface 26 and an interior surface 28. A spring cylinder 30 extends outwardly from the primary plate 20. The spring cylinder 30 is concentric with the primary hole 24. The inner diameter of the spring cylinder 30 is larger than the outer diameter of the primary hole 24. The spring cylinder 30 extends out to a distal end 32, which extends around the entire spring cylinder 30.

Extending around at least a portion of the distal end 32 of the spring cylinder 30 is a spacer 34. The spacer 34 is fabricated of a non-ferromagnetic material and will be discussed in greater detail subsequently.

Figure 2:
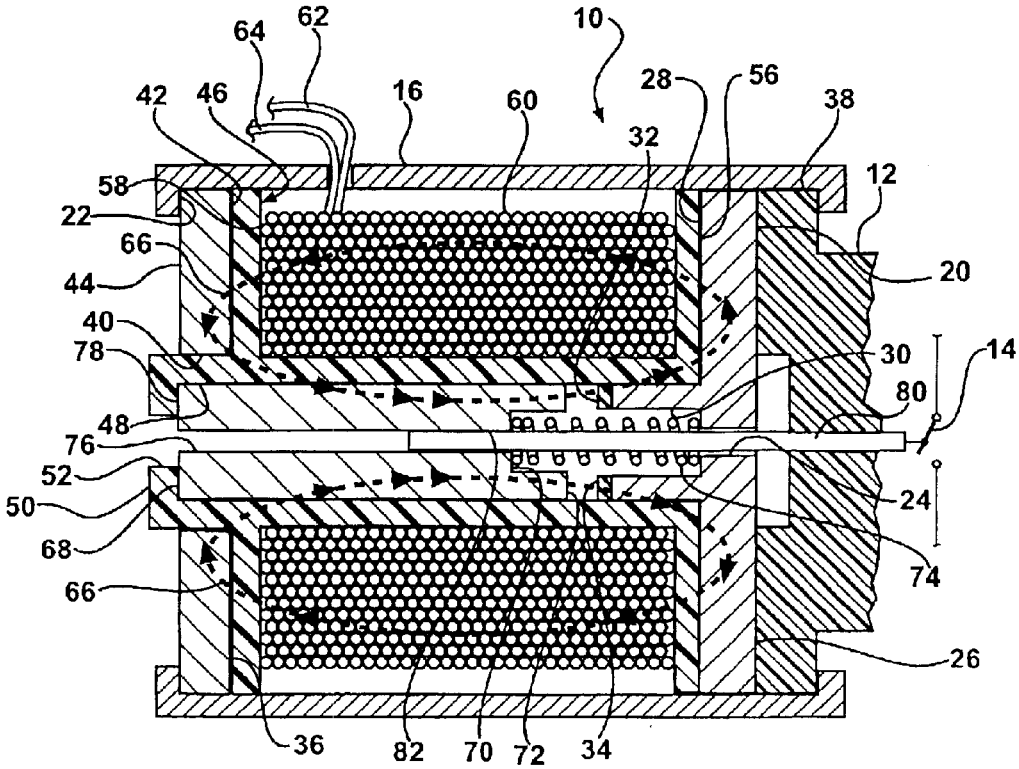
FIG. 2 is a cross-sectional side view of the actuator assembly configured in the normally open mode.

Opposite the end of the frame 16 having the first ridge 22 extends a secondary plate 36. The secondary plate 36 is adapted to be secured within the frame 16 by a second ridge, crimp or bent tab 38. The second ridge 38 defines an inner diameter that is smaller than the outer periphery of the secondary plate 36. While the secondary plate 36 is engagable with the second ridge 38, the device 12 extends between the secondary plate 36 and the second ridge 38. This allows the device 12 to be secured to the actuator assembly 10. Alternatively, the actuator assembly 10 can be fixed to the device 12 with traditional fasteners, such as bolts, screws, rivets and the like. The secondary plate 36 includes a secondary hole 40 that is coaxial with the longitudinal axis 47. In the preferred embodiment, the secondary hole 40 has an outer diameter that is larger than the outer diameter of the primary hole 24. Ideally, the primary 20 and secondary 36 plates are designed to have identical outer peripheries. This allows the two plates 20, 36 to be interchangeable within the frame 16. More specifically, as is shown in FIG. 2, the primary plate 20 can abut and be secured within the frame 16 by the second ridge 38 and the secondary plate 36 can be positioned to be secured within the frame 16 by the first ridge 22.

The secondary plate 36 includes a secondary interior surface 42 and a secondary exterior surface 44. In the preferred embodiment, the secondary interior 42 and exterior 44 surfaces are parallel with no protrusions extending out therefrom. The secondary plate 36 has a defined width between the surfaces 42, 44.

A bobbin, generally shown at 46, is housed within the frame 16. The bobbin 46 extends between the primary 20 and secondary 36 plates within the frame 16. The bobbin 46 includes a core 48 that extends through a portion of the center of the frame 16 coaxial and defines a longitudinal axis 47. The core 48 is hollow defining an inner diameter equal to the outer diameter of the spring cylinder 30. Therefore, the spring cylinder 30 is extendable into the core 48 a portion of its length.

One end of the core 48 includes an end wall 50. The end wall 50 acts as a stop 50 preventing the plunger 68 from moving therepast. The end wall 50 includes an end wall hole 52 that is coaxial with a longitudinal axis 47. The core 48 includes a core end 54 opposite the end wall 50. The core 48 is open at the other core end 54 allowing the spring cylinder 30 to enter the core 48.

Extending out from the core 48 arc two bobbin walls 56, 58. The bobbin walls 56, 58 extend out perpendicularly from the core 48 and are parallel to each other. In the preferred embodiment, the bobbin walls 56, 58 extend out to the frame 16. It is contemplated that the bobbin walls 56, 58 and the core 48 are fabricated from a non-ferromagnetic material, e.g., a plastic. The core 48 and the bobbin walls 56, 58 form a spindle or bobbin 46 about which a wire 60 is wrapped to form a coil. The coil 60 is conductive allowing it to pass an electrical current along its length thereof. The coil 60 is wound around the core 48 between the bobbin walls 56, 58. The coil 60 is wound around the core 48 enough such that the coil 60 covers the entire length of the core 48 between the bobbin walls 56, 58. Further, the wire 60 is wound around the core 48 sufficiently to extend the winding up along the bobbin walls 56, 58 a significant portion thereof.

The coil 60 extends between a first terminal end 62 and a second terminal end 64. The terminal ends 62, 64 are connected to a circuit providing an electrical current that is allowed to pass through the wire 60 on a selective basis. Alternatively, the terminal ends 62, 64 can be connected to two insert molded terminals and used to connect the coil 60 to an external circuit (not shown). More specifically, the electrical current may be turned on and off by a switch (not shown) that is a part of a circuit to which the terminal ends 62, 64 are connected. The current flowing through the coil 60 creates a magnetic field, represented by magnetic flux lines 66. The magnetic field will be discussed in greater detail subsequently.

The actuator assembly 10 also includes a plunger 68 that extends through a portion of the core 48 of the bobbin 46. The plunger 68 is movable with respect to the bobbin 46 in response to changes in the magnetic field. The plunger 68 includes a spring relief 70 adjacent a first plunger end 72. The spring relief 70 receives a spring 74 therein. The spring 74 extends between the spring relief 70 and a portion 75 of the interior surface 28 that is within the spring cylinder 30 of the primary plate 20. It should be appreciated by those skilled in the art that the portion 75 may or may not be coplanar with the rest of the interior surface 28. The plunger 68 extends between the first plunger end 72 and a second plunger end 78. Ideally, the spring relief 70 has an inner diameter that is larger than the outer diameter of the spring 74.

The plunger 68 further includes a rod receptacle 76 disposed adjacent the second plunger end 78. The rod receptacle 76 is a hole in the second plunger end 78 that is smaller in diameter than the spring relief 70 extending into the first plunger end 72. The rod receptacle 76 receives a rod 80 therein. The rod 80 extends from within the frame 16 to the device 12 along the longitudinal axis 47. The rod 80 is movable with the plunger 68 along the longitudinal axis 47 in response to the magnetic flux changes. The rod 80 is either connected to the device 12 and/or pushes/pulls the device 12 and, more particularly, the switch 14 of the device 12 whereby the rod 80 moves the switch 14 between the open and closed positions. The rod 80 extends into the rod receptacle 76 a distance sufficient to allow the plunger 68 to hold the rod 80 in place. The rod 80 is fixed to the plunger 68 by means of a crimp, press fit, thread, or any other traditional means of fixation.

The plunger 68 includes an opposing rod receptacle 82 extending through the first plunger end 72. The opposing rod receptacle 82 is capable of receiving the rod 80 therein. In the preferred embodiment, the rod receptacle 76 and the opposing rod receptacle 82 are two ends of a channel extending through the entire plunger 68.

With the actuator assembly 10 configured as shown in FIG. 1, with the plunger 68 in a first orientation, the actuator assembly 10 acts as a normally closed actuator assembly and operates the device 12 in a normally closed mode. When the coil 60 receives an electrical current, a magnetic field is generated through the core 48 of the bobbin 46. The plunger 68, a ferromagnetic cylinder, moves due to the magnetic field in a direction away from the secondary plate 36 and toward the primary plate 20. The force of the magnetic field is sufficient to overcome the bias generated by the compressed spring 74. With the movement of the plunger 68, the rod 80 is moved toward the secondary plate 36 which opens the switch 14. When the electric current is removed from the coil 60, the spring 74 forces the plunger 68 back toward the secondary plate 36 closing the switch 14. In the preferred embodiment, the second plunger end 78 does not extend beyond the secondary exterior surface 44 of the secondary plate 36 when in the closed position.

Referring to FIG. 2, the actuator assembly 10 is assembled using all of the elements set forth above. The assembly of the actuator assembly 10 is altered, however, to create an actuator assembly 10 that operates the device 12 in a normally open mode. In the normally open mode, the actuator assembly 10 is configured such that the bobbin 46 is installed within the frame 16 in an orientation opposite that of the bobbin 46 shown in FIG. 1. More specifically, the primary plate 20 is sandwiched between the bobbin wall 56 and the device 12. In addition, the secondary plate 36 is sandwiched between the bobbin wall 58 and the first ridge 22 of the frame 16.

Another distinction between the normally open configuration of the actuator assembly 10 and the normally closed configuration of the actuator assembly 10 is that the rod 80 extends through the opposing rod receptacle 82 and not the rod receptacle 76. The rod 80 also extends through the spring 74 and the primary hole 24 in the primary plate 20.

In operation of the actuator assembly 10 configured in the normally open mode, an electrical current is received through the first 62 and second 64 terminal ends which induces a magnetic field. This forces the plunger 68 to move towards the primary plate 20 forcing the rod 80 further out from the actuator assembly 10. This movement forces the switch 14 to move to a closed position. Upon the cessation of the electrical current passing through the coil 60, the magnetic field collapses and the spring 74 forces the plunger 68 back to its normally open position, far left in the core 48 of the bobbin 46. Again, the spacer 34 prevents the plunger 68 from magnetically locking onto the spring cylinder 30, in which case the spring 74 cannot overcome the residual magnetic field acting on the plunger 68, even after the coil 60 has been de-energized.

Many of the design parameters and configurations of the actuator assembly 10 may be modified. It should be appreciated by those skilled in the art that different characteristics and properties may be generated using different designs of the primary plate 20, the secondary plate 36, the spring cylinder 30, the plunger 68, and the like. These different designs may change the concentration of the magnetic field in particular areas which may change the control of the rod 80 or the speed in which the rod 80 travels between its positions.

The invention has been described in an illustrative manner. It is to be understood that the terminology, which has been used, is intended to be in the nature of words of description rather than of limitation.

Many modifications and variations of the invention are possible in light of the above teachings. Therefore, within the scope of the appended claims, the invention may be practiced other than as specifically described.

What is claimed:

1. An actuator assembly for operating a device in a normally open mode and a normally closed mode, said actuator assembly comprising:

a frame extending between a first ridge and a second ridge;

a primary plate adapted to be secured to one of said first ridge and said second ridge, said primary plate including a primary hole;

a secondary plate adapted to be secured to the other of said first and second ridges, said secondary plate including a secondary hole;

a bobbin defining a longitudinal axis and extending between said primary and secondary plates;

a coil wrapped around said bobbin, said coil receiving an electrical current to induce a magnetic field thereabout;

a rod extending along said longitudinal axis from within said frame to the device, said rod movable along said longitudinal axis in response to said magnetic flux to open and close the device; and a plunger extending through a portion of said bobbin and movable with respect thereto in response to changes in said magnetic field, said plunger including a rod receptacle for fixedly securing said rod therein allowing said rod to move with said plunger, said plunger further including an opposing rod receptacle disposed across said plunger from said rod receptacle such that said plunger is adapted to be oriented in a first orientation allowing said actuator assembly to operate the device in the normally open mode and a second orientation allowing said actuator assembly to operate the device in the normally closed mode, wherein said opposing rod receptacle fixedly securing said rod therein when said actuator assembly is operating the device in the normally closed mode.

2. An actuator assembly as set forth in claim 1 wherein said rod extends through said primary hole when said actuator assembly is operating the device in the normally open mode.

3. An actuator assembly as set forth in claim 2 wherein said rod extends through said secondary hole when said actuator assembly is operating the device in the normally closed mode.

4. An actuator assembly as set forth in claim 3 including a spring for biasing said plunger away from said primary plate.

5. An actuator assembly as set forth in claim 4 wherein said plunger includes a spring relief surrounding said rod receptacle for receiving said spring thereagainst.

6. An actuator assembly as set forth in claim 5 wherein said primary plate includes a spring cylinder extending inwardly from said primary plate within said bobbin to receive said spring therein.

7. An actuator assembly as set forth in claim 6 including a spacer extending about said spring cylinder.

8. An actuator assembly as set forth in claim 7 wherein said bobbin includes a stop preventing said plunger from moving therepast.

9. An actuator assembly as set forth in claim 8 wherein said bobbin includes a core extendable through said secondary hole of said secondary plate.

10. An actuator assembly as set forth in claim 1 including a spring for biasing said plunger away from said primary plate.

11. An actuator assembly as set forth in claim 10 wherein said plunger includes a spring relief surrounding said rod receptacle for receiving said spring thereagainst.

12. An actuator assembly as set forth in claim 11 wherein said primary plate includes a spring cylinder extending inwardly from said primary plate within said bobbin to receive said spring therein.

13. An actuator assembly as set forth in claim 12 including a spacer extending about said spring cylinder.

14. An actuator assembly as set forth n claim 13 wherein said bobbin includes a stop preventing said plunger from moving therepast.

* * * * *